US005327827A

United States Patent [19]

Richardson

[11] Patent Number: 5,327,827

[45] Date of Patent: Jul. 12, 1994

[54] AUTOMATED SCREEN PRINTING PALLET AND RETAINING FRAME ASSEMBLY

[75] Inventor: Orland W. Richardson, Columbus, Ohio

[73] Assignee: Columbia Research and Development, Westerville, Ohio

[21] Appl. No.: 36,911

[22] Filed: Mar. 25, 1993

[51] Int. Cl.[5] ..... B41F 15/34

[52] U.S. Cl. ..... 101/126; 101/127.1; 38/102.2; 100/233; 16/361

[58] Field of Search ..... 101/114, 115, 126, 127.1, 101/128, 128.1, 474; 38/37, 102.2, 102.91; 100/233, 271, 293; 16/357, 361

[56] References Cited

U.S. PATENT DOCUMENTS

| | | | |
|---|---|---|---|
| 2,420,142 | 5/1947 | Levin | 100/233 |
| 3,244,093 | 4/1966 | Vasilantone | 101/126 |
| 4,022,156 | 5/1977 | Esterline | 101/126 |
| 4,907,506 | 3/1990 | Davis et al. | 101/115 |

*Primary Examiner*—Edgar S. Burr

*Assistant Examiner*—Stephen R. Funk

*Attorney, Agent, or Firm*—Francis T. Kremblas, Jr.

[57] ABSTRACT

An automated pallet and garment retaining frame for screen printing apparatus including a pallet mounted on a supporting base and provided with a planar, horizontally extending printing surface for receiving a layer of material to be printed. The retaining frame includes a central opening and is mounted for pivotal movement to the supporting base about a first hinge disposed rearwardly of said pallet relative to an opposing front end adapted to load the garment for printing. The rear hinge is also movably mounted in a cam slot for travel in a vertical and horizontal direction as the pallet is caused to move by a piston and cylinder assembly located between the rear hinge point and the rear end of the retaining frame. The forward end of the retaining frame is adapted to engage the forward end of the pallet to form a second hinge about which the retaining frame rotates as it is caused to move between an open fully raised position and a closed position retaining the garment in taut condition on the pallet.

10 Claims, 8 Drawing Sheets

AUTOMATED SCREEN PRINTING PALLET AND RETAINING FRAME ASSEMBLY

TECHNICAL FIELD

The present invention relates generally to screen printing apparatus and particularly to a mechanically actuated retaining frame which cooperates with a pallet to secure the textile material in a planar and taut condition to accept screen printing indicia.

BACKGROUND ART

The screen printing industry has grown tremendously over the last few decades. Various garments such as jackets, sweat shirts and other textile substrates are screen printed to place various indicia upon the substrate. The typical prior art apparatus used, whether on the single or multiple station type, include a planar pallet upon which the garment is positioned and an open frame which is pivoted at an inboard or rearward point between an open position allowing the garment to be mounted on the pallet and a closed position engaging the peripheral edge of the pallet to secure the garment upon the pallet prior to moving the printing screen carrying the selected indicia into contact with the garment. The general operation of this type of screen printing apparatus is well-known in the industry.

The inner peripheral edge of the open retaining frame typically is provided with a resilient seal which frictionally engages the portion of the garment overlying the surrounding edge of the pallet to grip the garment material between the seal and the outer edge of the pallet to pull it tightly over the planar surface in a taut condition to accept the screen printing without subsequent distortion after removing the garment.

The retaining frame is pivoted to a support frame or the base of the printing apparatus at its rearward end so that the opposite or forward end is open and free from obstruction to permit the garment to be mounted on the pallet. Typically, the print screen and its associated ink holder and squeegee applicator are similarly pivoted in an independent manner at the inner end to be moved into engagement over the pallet after the retaining frame is moved into its closed position. Typical examples of such screen printing apparatus include those commercially available and sold by Richardson Industries located in Columbus, Ohio under the tradenames Richardson-66, Model 8800 and Apex-64 carousel type printers.

One of the problems associated with the conventional construction of prior art retaining frames is the very significant force required to move the retaining frame to its final closed position about the rearwardly located hinge point. The frictional resistance which pulls the material taut between the retaining frame seal and the outer edge of the pallet is the greatest at this point.

While this is not an insurmountable problem in a manually operated construction, wherein the final closing force is manually applied to the outer end of the retaining frame, it has been a significant deterrent to automating or constructing a mechanically powered retaining frame assembly because the forward or outer end of the pallet must be free and open to allow convenient loading of the garments onto the pallet. Further, locating a power piston or equivalent driving means at the inner end near the pivot axis of the retaining frame has not been practical because of the very significant force required to fully close the frame over the pallet.

The disadvantageous leverage involved in the conventional construction would require a linear actuator too large to be economically practical.

Prior to the present invention, a practical and efficient mechanically automated screen printing retaining frame construction has eluded those skilled in the art in spite of the desirability of such a feature to increase productivity and convenience of the operation.

BRIEF DISCLOSURE OF INVENTION

The present invention relates generally to screen printing apparatus and particularly to an improved retaining frame construction which is mechanically operated between its open and closed position relative to the garment receiving pallet. In general, the retaining frame of the present invention includes an open frame provided with a resilient inner lip or seal adapted to closely fit and frictionally engage the outer edges of a planar pallet in a generally similar manner to a conventional device to effect securing the garment to be printed upon in a taut condition over the pallet.

The improvement of the present invention revolves around the novel path of movement of the retaining frame between its open and closed positions. The retaining frame is pivoted at its inner end about a movable hinge axis which is mounted in a cam slot allowing vertical and horizontal travel of the pivot or hinge pins within the slot and includes a flange at its outer or forward end which cooperates with the forward edge of the pallet to form another hinge axis about which the retaining frame pivots to complete its closing action.

Linear actuators in the form of piston and cylinder assemblies are employed to drive the retaining frame through its path of movement at the inner end of the pallet at a point between the rearward and forward hinge axes such that a significant mechanical advantage is obtained to effect the final closing action of the frame about its outer hinge point when the force required for closing is at its highest value.

Appropriate conventional power and control means are provided to operate the linear actuators in a relatively simple and safe manner for the manual operator to reduce the risk of inadvertent injury. Commercially available rotary manifolds can be conventionally mounted on carousel type printing apparatus to accommodate any connection requirement of fluid pressure to the linear actuators associated with each pallet and retaining frame assembly.

DETAILED DESCRIPTION

Figure 7:
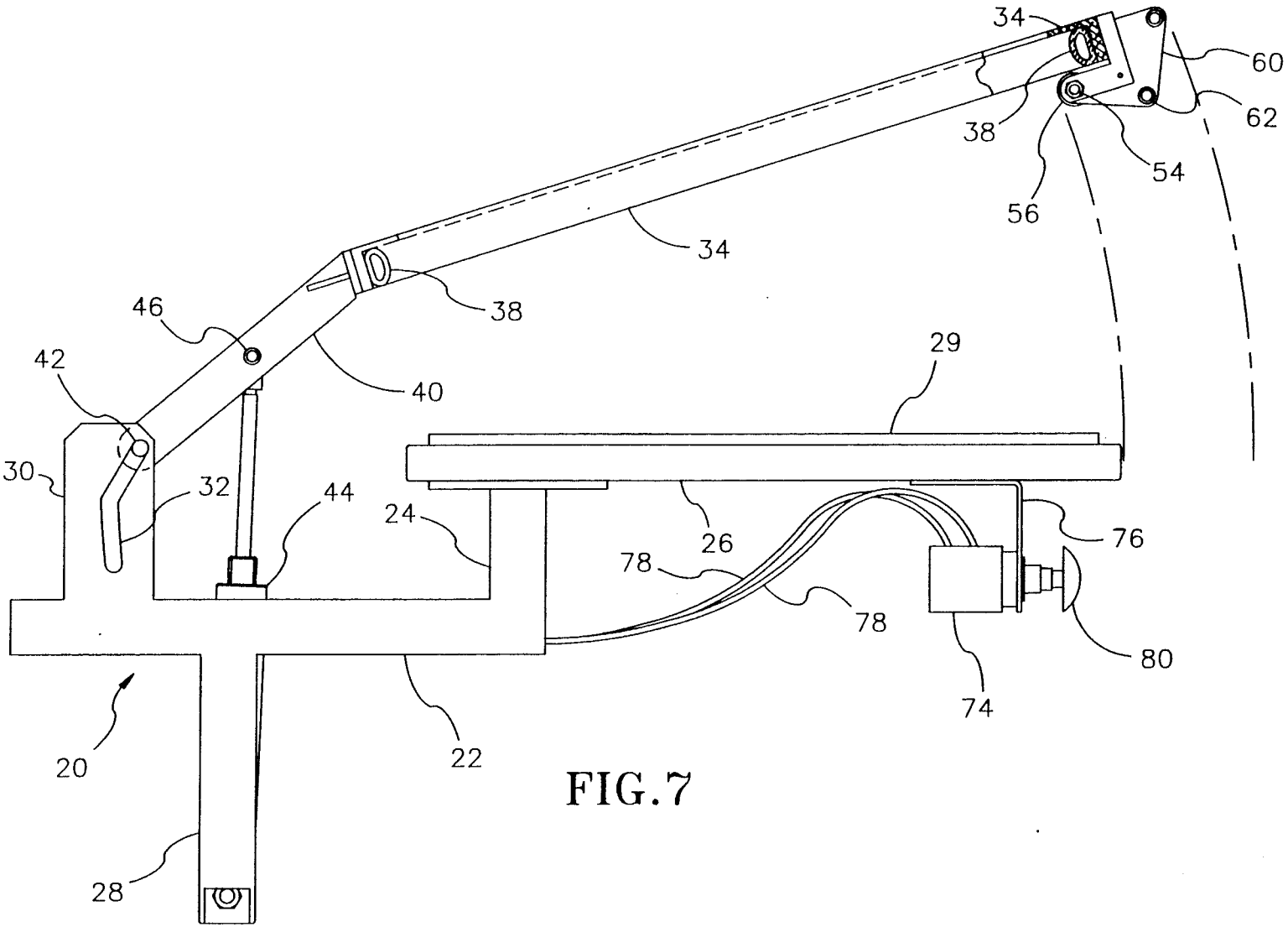
FIG. 7 is a left side elevational view of the apparatus shown in FIG. 1 illustrating the retaining frame in a fully open position.

A screen printing pallet and garment retaining assembly constructed in accordance with the present invention is illustrated in the fully closed position in FIGS. 1–4 and includes a base or support member indicated generally at 20 which includes a pair of horizontal support members 22, each provided with a forwardly extending vertical platform 24 upon which a garment receiving pallet 26 is fixedly mounted in a conventional manner as best seen in FIG. 7.

Base 20 also includes a pair of laterally spaced downwardly extending legs 28 and a pair of laterally spaced upstanding ears 30 provided with a cam slot 32 defining a vertical and horizontal path. Base 20 may be conventionally mounted to a single or multiple station screen printing machine in any conventional manner to cooperate with a printing screen reservoir and squeegee assembly, not shown, which is mounted for independent movement toward and away from the pallet and retaining frame combination as is well-known in the art.

Figure 5:
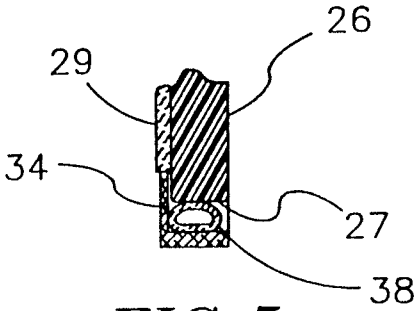
FIG. 5 is a front sectional view of a portion of the apparatus shown in FIG. 4, the section being taken along line 5—5 in FIG. 4 illustrating the close fit relationship between the movable retaining frame and the peripheral edge of the pallet.
Figure 4:
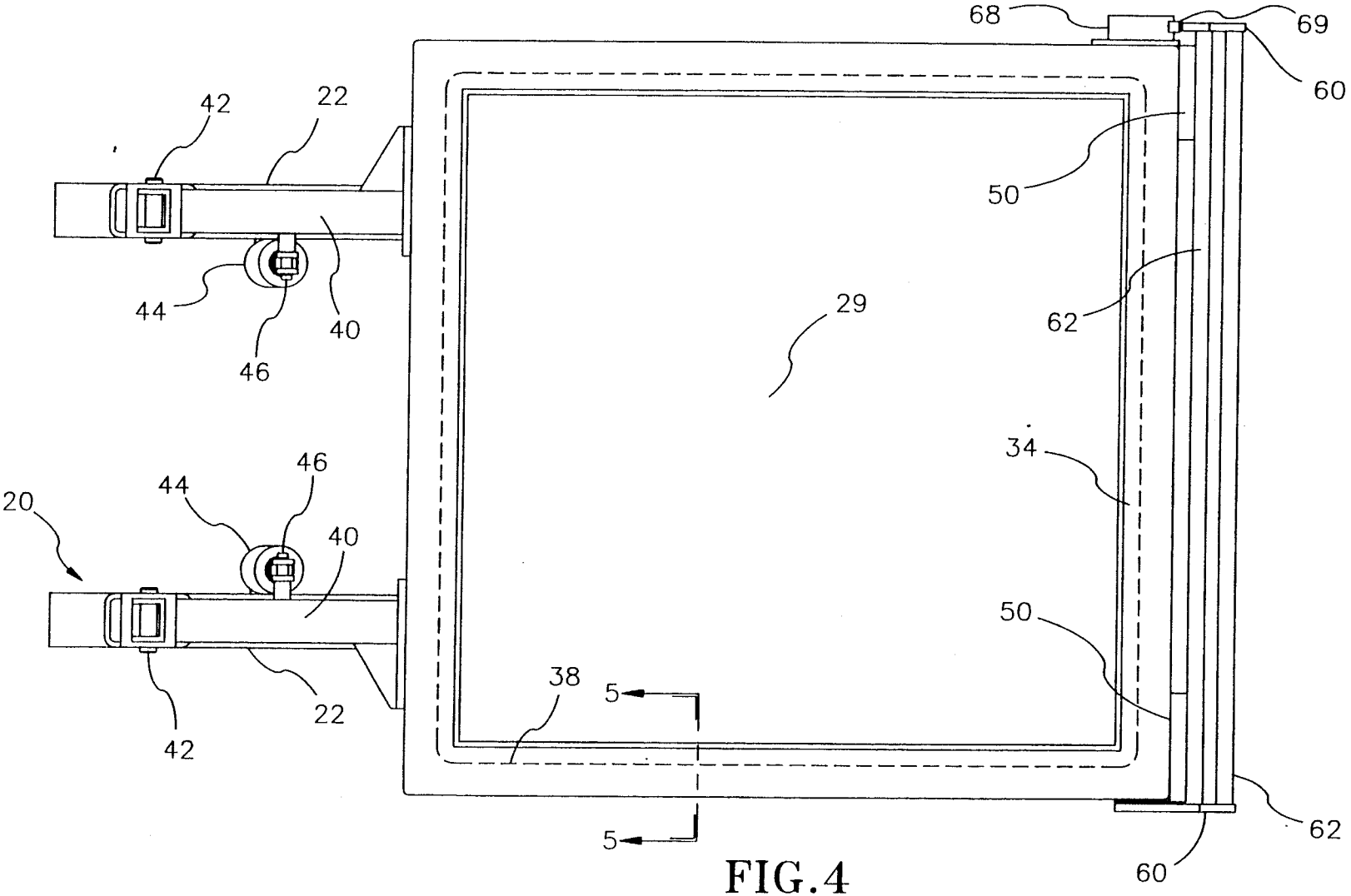
FIG. 4 is a top plan view of the apparatus shown in the preceding figures.
Figure 6:
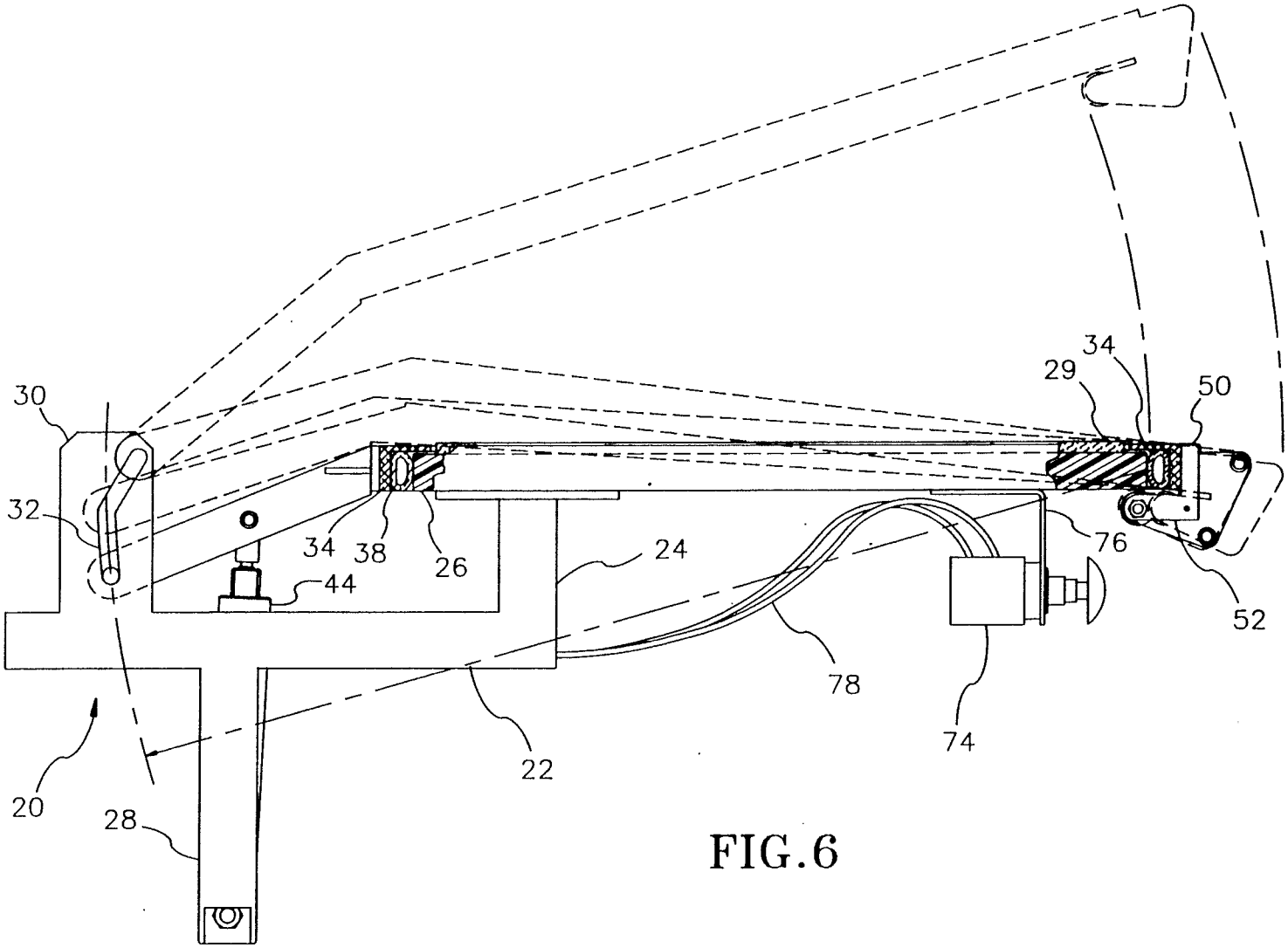
FIG. 6 is a left side elevational view similar to the view shown in FIG. 1 which also illustrates the path and sequence of movement of the retaining frame relative to the pallet between fully opened and closed positions and which includes a partial side sectional view of each end of the pallet and retaining frame similar to the view shown in FIG. 5.

As best seen in FIGS. 1–4, a garment retaining frame 34 is provided with a central opening conformed to receive the upraised printing surface 29 of pallet 26. As best seen in FIGS. 4–6, frame 34 is generally L-shaped and includes a surrounding resilient seal 38 fixed to the vertical leg of frame 34 which is adapted to frictionally engage the outer edge portion 27 of pallet 26.

The horizontal leg of frame 34 defines the central opening in the frame which is configured to fit adjacent to upraised printing surface 29 of pallet 26.

The rearward or inboard end of frame 34 includes a pair of laterally spaced pivot arms 40 having their forward ends welded or otherwise fixed to the outer surface of frame 34. The rear end of each arm 40 is pivotally mounted on a hinge pin 42, which in turn, is extended through cam slot 32 provided in each ear 30 for slidable travel along the length of cam slot 32.

A pair of conventional linear actuators in the form of pneumatic piston and cylinder assemblies 44 are pivotally connected at 45 to a respective leg 28 at their lower end with the extendable piston pivotally connected at its upper end about a pin 46 located intermediate the ends of each arm 40.

As best seen in FIG. 7, the forwardly or outboard end of frame 34 includes a pair of laterally spaced L-shaped flange portions, each fixed via bolts or the like to the downwardly extending leg of frame 34. Each flange has a vertically extending leg 50 and a pair of inwardly directed legs 52 fixed to each end of leg 50. A shaft 54 is fixedly mounted between the legs 52 of each flange and includes a collar-like bearing 56 freely mounted for rotation about shaft 54.

Also rotatably mounted to the ends of each shaft 54 is an actuation assembly indicated generally at 58. Assembly 58 comprises a pair of outer cover plates 60 which may be fixed to a pair of parallel extending but vertically and horizontally staggered trip rods 62 in any conventional manner. Cover plates 60 are each pivotally mounted to the outer ends of a respective shaft 54. A hole 64 is provided in each cover plate 60 which surrounds a smaller pin 66 press fit or otherwise fixed to the outer leg 52 of each flange and extended slightly outwardly of the cover plate 60 to function as a stop to limit the pivot arc of the cover plates about shaft 54 in both a clockwise and counterclockwise direction. Hole 64 and pin 66 are located such that the force applied by a spring biased button or pin 69 against cover plate 60 defines the limit of rotation of cover plate 60 in a counterclockwise direction as viewed in FIG. 2. Therefore assembly 58 is free to rotate clockwise only a distance sufficient to depress pin 69 to actuate pneumatic switch valve 68 before pin 66 engages the opposing side of hole 64.

Figure 2:
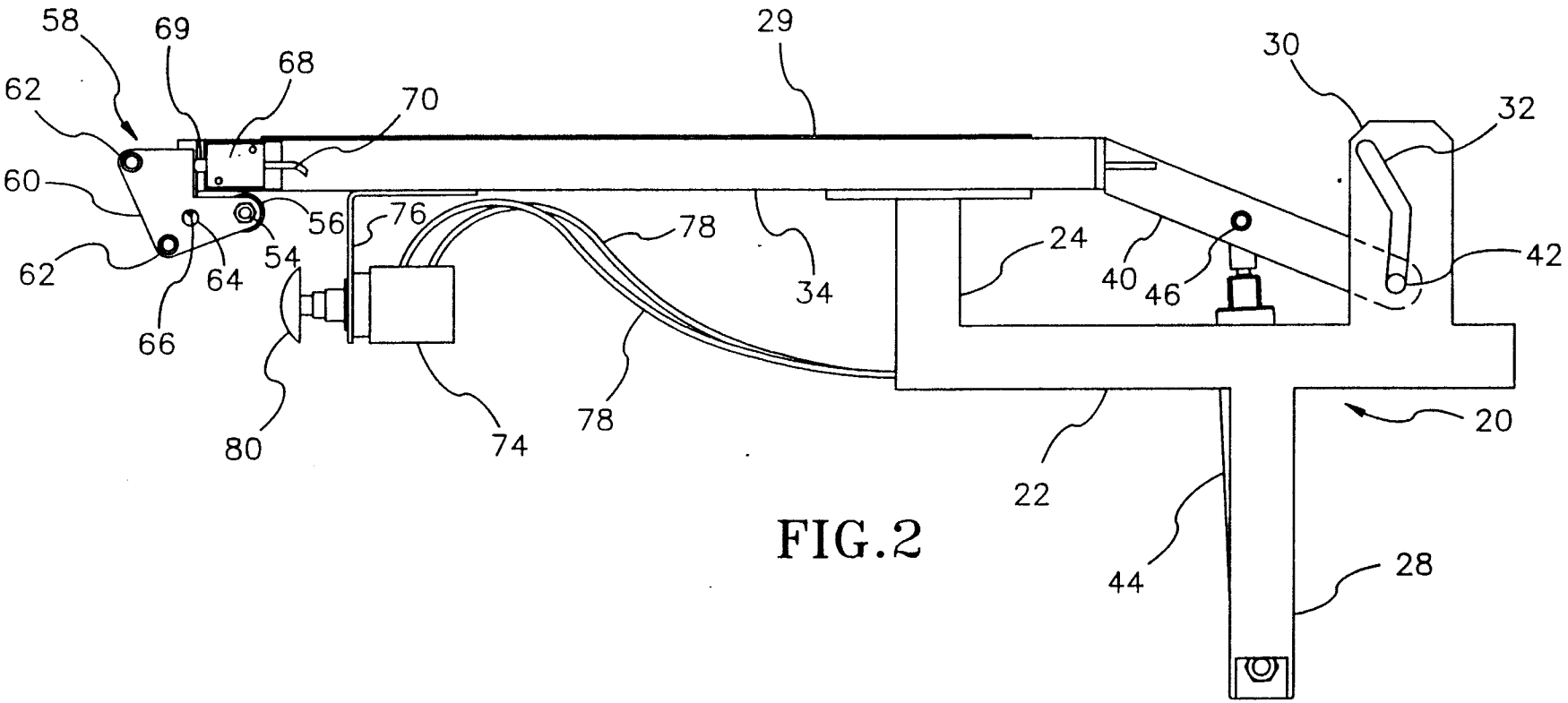
FIG. 2 is a right side elevational view of the apparatus shown in FIG. 1.
Figure 3:
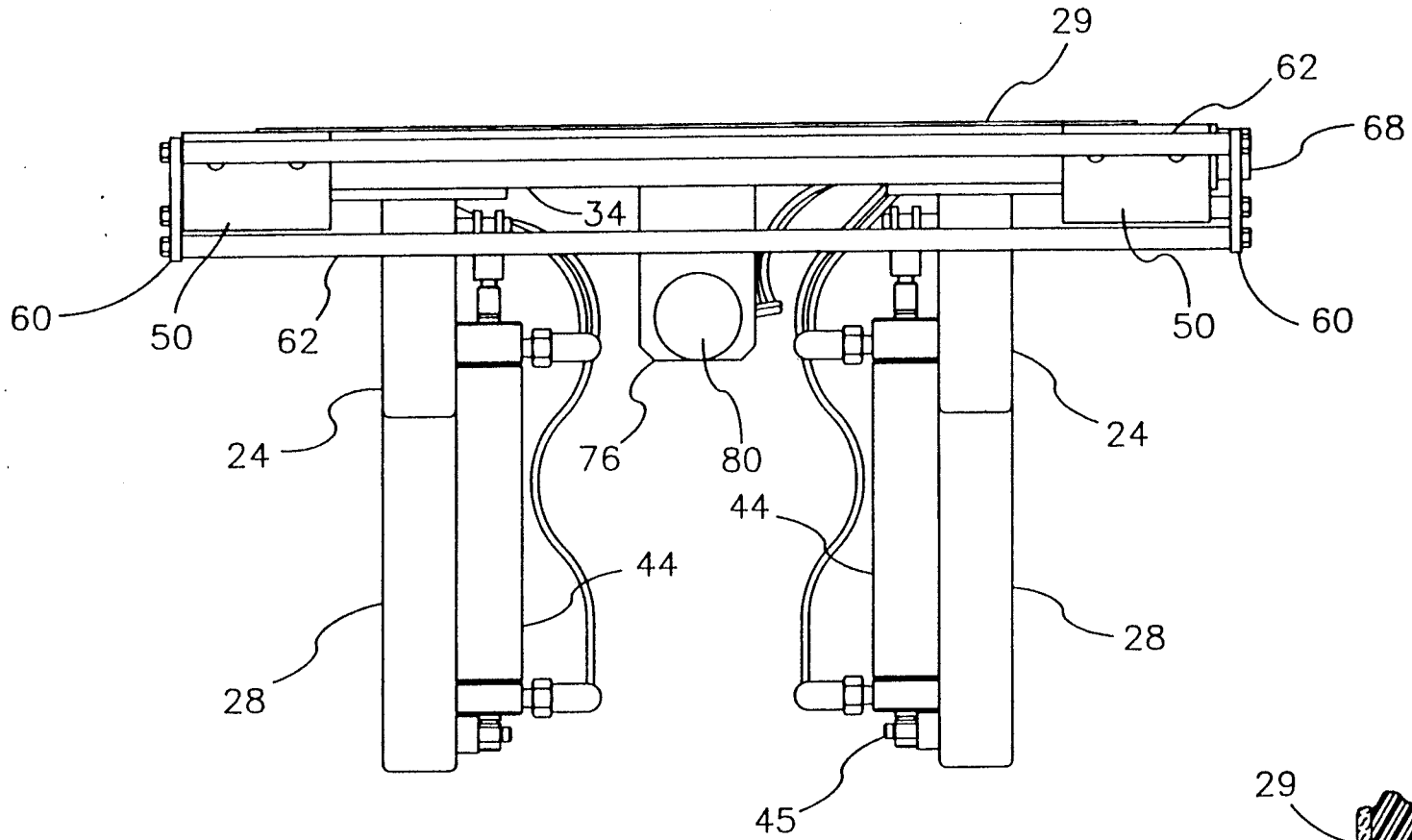
FIG. 3 is a front elevational view of the apparatus shown in the preceding figures.

As best seen in FIG. 2, the cover plate 60 on the right side of assembly 58 is mounted in force-transmitting engagement with outwardly spring biased actuation button or pin 69 which forms part of conventional pneumatic switch valve 68 operatively connected via line 70 to a conventional pneumatic circuit, not shown, which supplies air pressure to operate the pneumatic piston and cylinder assemblies 44, in a manner well-known to one skilled in the art.

Switch valve 68 is fixed to an outer side portion of frame 34 and is manually actuated by pressing inwardly on the upper one of rods 62 or lifting upwardly on the lower rod 62 to cause the cover plates 60 to rotate clockwise against the biased actuator pin 69. The actuation of switch valve 68 causes air pressure to simultaneously drive the piston of each assembly 44 upwardly to move frame 34 to its open position as fully described later herein.

Another conventional pneumatic switch valve 74 is mounted to a bracket 76, which in turn is fixed to the lower surface of pallet 26 and is operatively connected to the conventional pneumatic circuit, not shown, and operating assemblies 44 via flexible conduits 78. A manually operated actuator button 80 extends forwardly within convenient, but safe reach of the operator who loads and removes garments from the forward end of pallet 26. Switch valve 74 operates to cause the pistons of assembly 44 to simultaneously retract from their fully extended position shown in FIG. 7 to begin the closing sequence of frame 34.

The actuator assembly 58 which actuates the opening sequence of frame 34 is preferably provided with the spaced rods 62 to provide a safety feature for the operator to permit actuating the opening sequence or halt the closing sequence of frame 34 by mere movement of the operator's body into engagement with the upper rod 62 or by using his hands to lift lower rod 62. Other forms of actuating assemblies could be employed without departing from the spirit of the present invention.

Now referring to FIGS. 6–9, the opening and closing sequence of frame 34 is illustrated. FIG. 6 illustrates in ghost lines the path of travel of frame 34 between the fully opened position shown in FIG. 7 to the fully closed position shown in both FIGS. 1 and 2.

As shown in FIG. 7, piston and cylinder assemblies 44 have been actuated to their fully extended position driving arms 40 upwardly to cause the hinge pins 42 to slide in the respective cam slots 32 to their uppermost hinge position at the upper end of slot 32.

Figure 8:
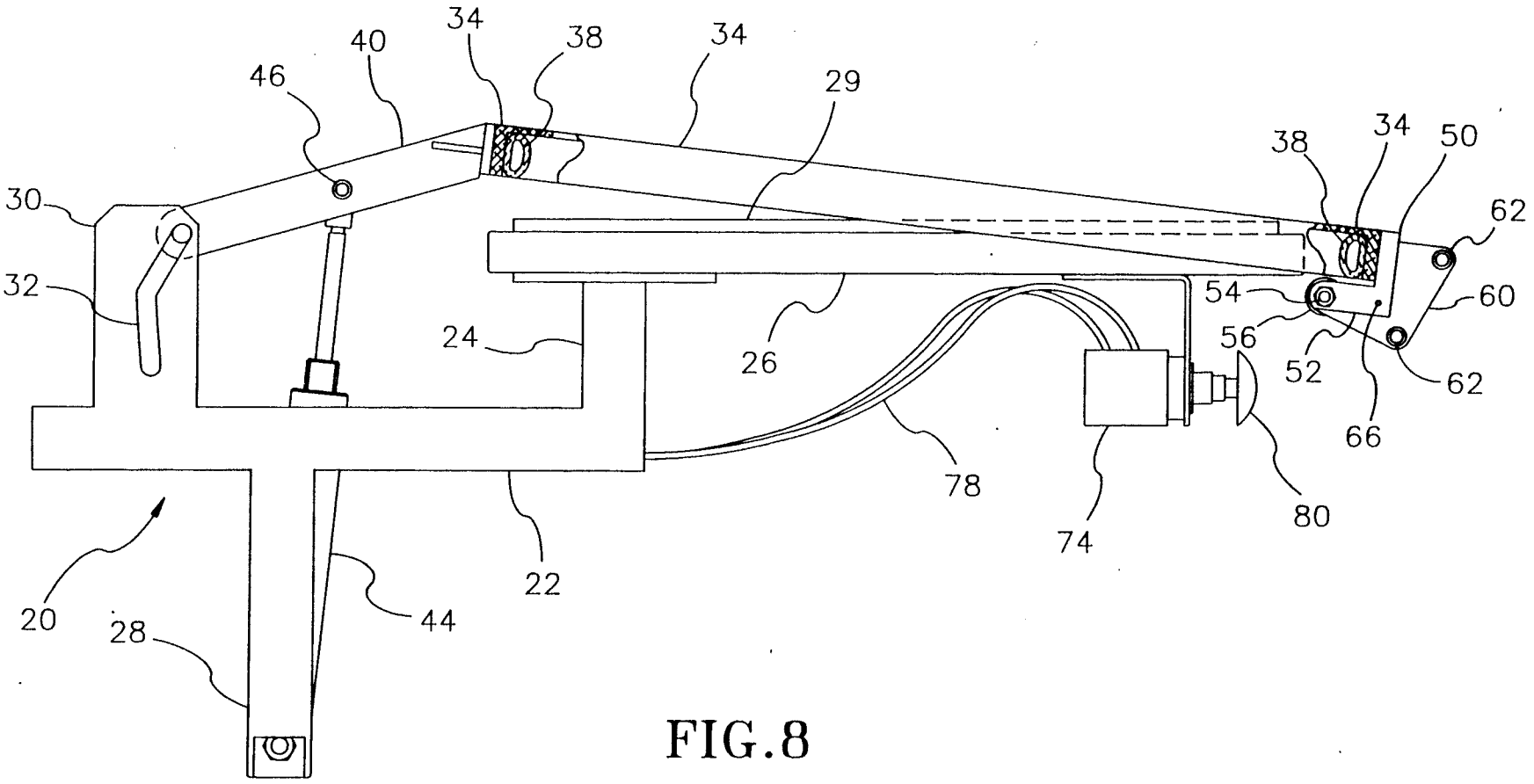
FIG. 8 is a left side elevational view of the apparatus shown in FIG. 1 illustrating the retaining frame in an initial downwardly pivoted position as it moves from the open position shown in FIG. 7 toward its closed position shown with the left cover plate of the actuator assembly removed from the remaining portion of the apparatus.

Upon manual actuation of button 80, the pistons of assembly 44 begin to initially retract and cause the arms 40 and frame 34 to pivot about the hinge point formed at the upper end of cam slot 32 to swing arms 40 and frame 34 to the lowered position shown in FIG. 8. The radius of the arc of travel of frame 34 as seen in FIG. 7 is selected to permit the inwardly directed leg 50 and the collars 56 on shaft 54 to swing clear of the leading edge and below the plane of the lower surface of pallet 26.

As the pistons of assemblies 44 continue to retract, arms 40 continue to be lowered and hinge pins 42 are caused to slide downwardly and inwardly along the upper portion of cam slot 32. This draws the rear end of frame 34 lower and rearwardly to the position shown in FIG. 9. Also the forward end of frame 34 is moved inwardly so that legs 52 carrying shaft 54 and collars 56 have then moved to a position under the front edge of pallet 26 and inner seal 38, fixed to the vertical leg of frame 34, has moved into engagement with the front or leading edge of pallet 26.

Figure 1:
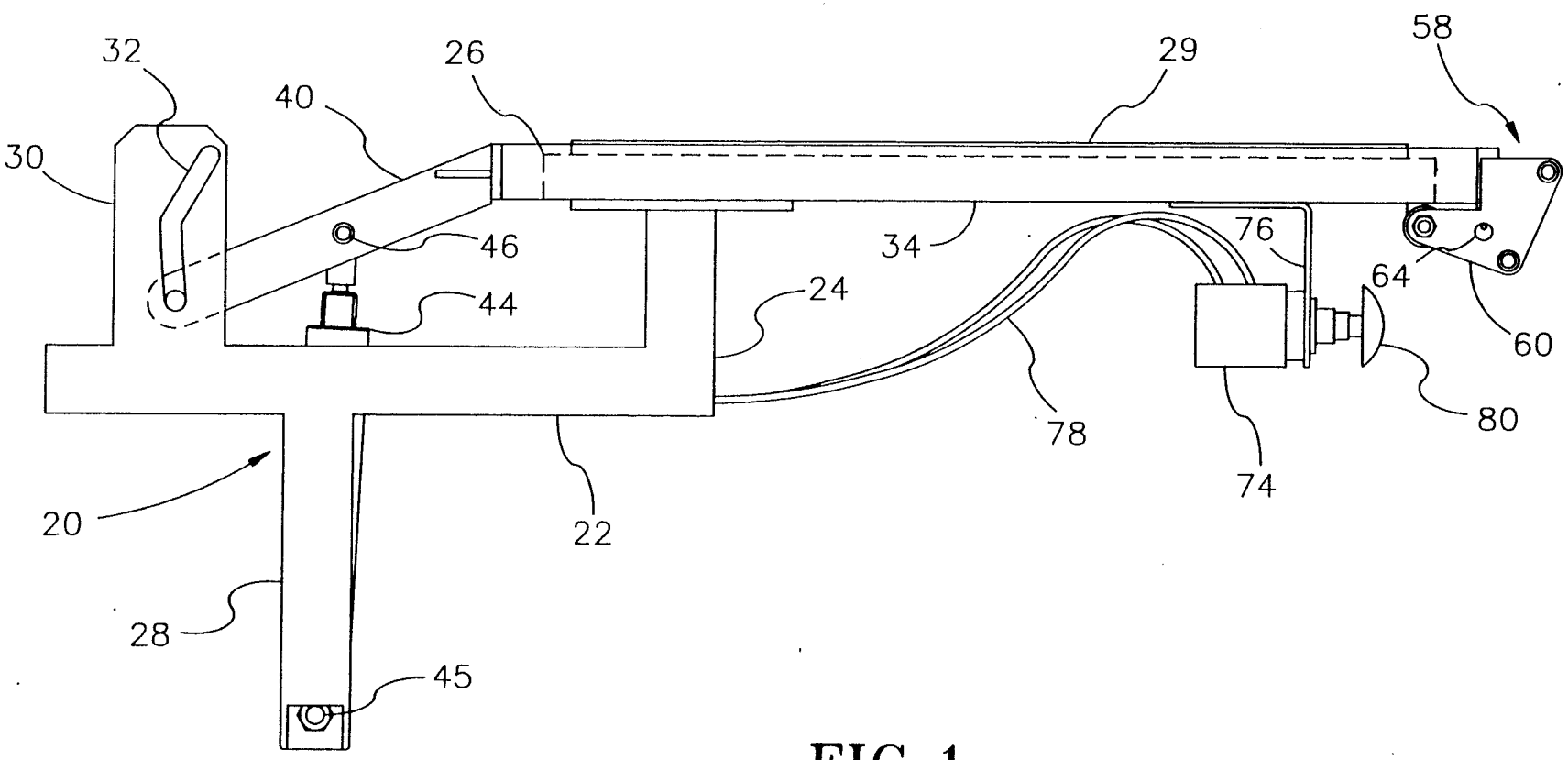
FIG. 1 is a left side elevational view of a screen printing pallet and retaining frame assembly constructed in accordance with the present invention and shown in the fully closed position.
Figure 9:
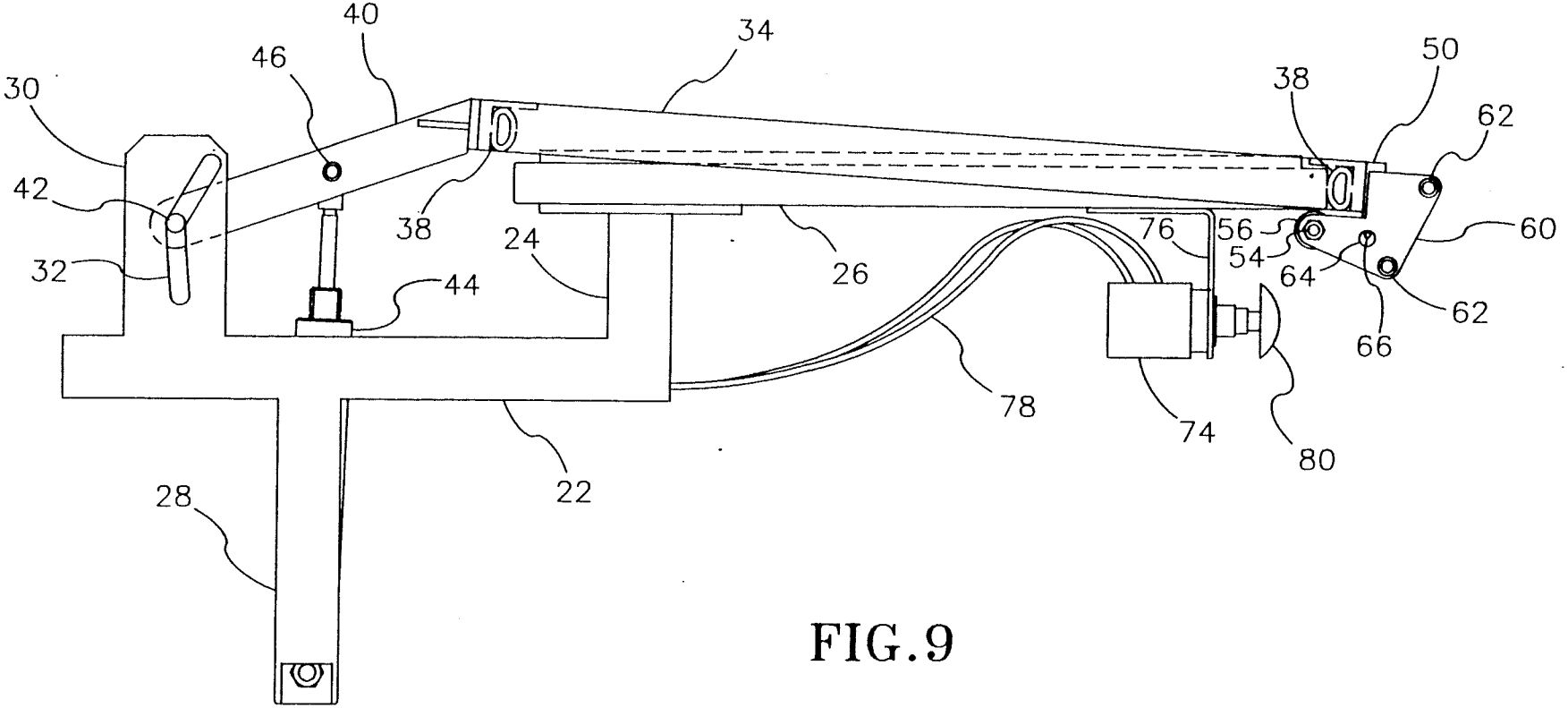
FIG. 9 is a left side elevational view of the apparatus shown in FIGS. 1 illustrating the retaining frame in a subsequent position relative to that shown in FIG. 8 as the front flange thereof moves inwardly under the lower surface of the front edge of the pallet and the vertical portion of the flange engages the front peripheral edge of the pallet to form another hinge point about which the frame rotates as it moves to the closed position shown in FIG. 1.

As best seen in FIGS. 6 and 9, the seal 38 fixed to the front portion of the opening in frame 34 is drawn into engagement with a portion of the edges of pallet 26 and the L-shaped flange formed by legs 50 and 52 is tilted slightly downward relative to the square position assumed in the fully closed position shown in FIGS. 1 and 2.

Upon continued retraction of the pistons of assemblies 44 from the position shown in FIG. 9, the point of engagement of the frame 34 and the forward edge of pallet 26 become a hinge point for rotation of frame 34 as arms 40 are lowered and hinge pins 42 are caused to slide downwardly in cam slot 32 from the intermediate position shown in FIG. 9 toward the fully closed position shown in FIGS. 1 and 2.

It should be noted that the lower portion of cam slot 32 may be essentially vertical to the horizontal since the arc defined by the distance between pivot pins 42 and the forward hinge point is relatively large compared to the circumferential distance traveled, however, preferably, this lower portion of slot 32 is curved to mate with the circumference of a circle having a center at the forward hinge point described herein.

Preferably, the position of leg 52, shaft 54 and bearings 56 are adapted to provide a small clearance between bearings 56 and the lower surface of pallet 26 when leg 52 is drawn under pallet 26. The degree of clearance selected is dependent upon the thickness of material to be imprinted, however, approximately 1/16 of an inch provides adequate clearance for the most common materials encountered to prevent any damage to the material during the opening and closing sequence. Further, use of the bearings 56 also reduces the frictional engagement between any material lying between bearings 56 and the lower surface of pallet 26 which occurs during the opening and closing sequence of pallet 26.

Legs 52 essentially form a latch or stop during the closing sequence as frame 34 rotates about the forward pivot point to limit any tendency of the forward end of frame 34 to rise upwardly too far above pallet 26 as it is moved into the final closed position and loosen its frictional engagement with the layer of material trapped between seal 38 and the edge of pallet 26.

During this last portion of the closing sequence of frame 34, the downward force required to overcome the frictional engagement between the outer edges of pallet 26 and the resilient seal 38 carried by frame 34 is significantly lessened compared to prior art constructions due to the mechanical advantage obtained by locating another pivot or hinge point at the forward edge of pallet 26 relatively distant from the application of force at the pin 46 connecting the pistons to arms 40.

Compared to the conventional single, rearwardly located pivot axis, the present invention requires a relatively much smaller force to be applied to overcome the resistance of the frictional engagement between the frame and the pallet. This allows a relatively small and inexpensive piston assembly to be employed and still be located rearwardly of pallet 26 to maintain an open and free area at the front of the pallet to conveniently load and unload a garment onto pallet 26 when the frame is in an open position. Therefore the configuration of the present invention permits one to conveniently automate the opening and closing of the retaining frame at a economically practical cost to increase productivity in an efficient and safe manner.

Further, using standard loading practices to mount a garment on pallet 26, such as a jacket or the like, test results have shown that the mechanical closing action of frame 34, as described herein, very effectively tightens and holds the garment in the desired taut condition against the underlying upper surface of pallet 26 in a very reliable and repetitive manner to eliminate distortion of the screen print applied to the layer of material held on pallet 26. In fact, the closing sequence described herein appears to function better than the single pivot manually operated prior art retaining frames, particularly relative to achieving a desirable degree of tautness even if the material is not initially loaded onto the pallet as carefully as desired in a substantially wrinkle-free condition.

I claim:

1. A pallet and garment retaining assembly for screen printing apparatus comprising, in combination;

a) a supporting base;

b) a pallet mounted to and extending outwardly from said base and provided with a generally planar upper and lower surface and a peripheral edge, said upper surface configured to receive a layer of material in a generally planar condition for screen printing;

c) a retaining frame including a central opening configured to generally conform to the configuration of said peripheral edge of said pallet, said frame including a downwardly extending vertical leg;

d) a rearward end of said retaining frame being pivotally mounted to said supporting base about a rearwardly disposed hinge axis selectively movable along a vertical and horizontal path when said retaining frame is moved between a raised open position non-engaging said pallet and a lowered closed position wherein said vertical leg of said retaining frame is disposed in close-fitting relationship with said peripheral edge of said pallet to frictionally engage a portion of said layer of material disposed between said vertical leg and said peripheral edge;

e) a portion of said vertical leg disposed at a forward end of said retaining frame being conformed to pivotally engage a forward portion of the peripheral edge of said pallet during a selected portion of the path of travel of said retaining frame to form a second hinge axis about which said retaining frame pivots while moving between said open and closed positions; and f) a linear actuator connected between a rearward portion of said frame and said supporting base and disposed between said first and second hinge axes to drive said frame along its path of travel between said open and closed positions.

2. The apparatus defined in claim 1 including a pivot arm having a forward end fixed to and extending rearwardly of said rearward end of said frame and an opposing end slideably mounted in a cam slot provided in said supporting base for travel along said vertical and horizontal path within said cam slot and pivotally movable at a selected position within said cam slot to cause said retaining frame to rotate about a preselected arc.

3. The apparatus defined in claim 2 wherein said linear actuator is a piston and cylinder assembly pivotally connected between said pivot arm and said supporting base at a location intermediate each end of said pivot arm.

4. The apparatus defined in claim 1 wherein said vertical leg of said retaining frame includes an inwardly directed resilient seal.

5. A garment retaining frame adapted for use with a conventional screen printing pallet comprising, in combination;

a) a supporting base including a forwardly extending pallet having a generally horizontal planar upper surface, a rear end, a forward end defining a loading position for receiving a layer of material in a generally planar condition and including a peripheral edge surrounding said planar upper surface;

b) a retaining frame member having a central opening and conformed to receive the peripheral edge of said pallet in a close-fitting relationship to frictionally engage and secure a layer of material between said frame and the peripheral edge of said pallet;

c) and mounting means movably connecting said frame to said supporting base between a raised open position free of engagement with said pallet and a closed position wherein side portions of said frame are disposed in said close-fitting relationship with the peripheral edge of said pallet; said mounting means including a first hinge rearwardly disposed relative to said pallet for rotating said frame about a generally horizontally disposed axis and a second hinge having a generally horizontal axis of rotation disposed adjacent to said forward end of said pallet and formed by the cooperative engagement of a forwardly disposed surface of said retaining frame and a portion of the forward end of said pallet during a selected portion of travel of said retaining frame between said open and closed positions; said first hinge being movably mounted along a selected path of travel between a first position permitting said retaining frame to rotate through a first selected arc and a second position vertically and horizontally spaced from said first position to permit said frame to be moved in a horizontal and vertical direction relative to said pallet and to be rotated about said second hinge axis through a second selected arc during travel between said open and closed positions.

6. A garment retaining frame adapted for use with a conventional screen printing pallet and screen printing apparatus comprising, in combination;

a) a supporting base including a forwardly extending pallet having a generally horizontal planar upper surface, a forward end defining a loading position for receiving a layer of material in a generally planar condition and a peripheral edge surrounding said upper surface;

b) a retaining frame having a central opening and conformed to receive the peripheral edge of said pallet in a close-fitting relationship to frictionally engage and secure a layer of material between said frame and the peripheral edge of said pallet; said retaining frame movably mounted to said supporting base about a first hinge for rotation about a generally horizontal axis and a second hinge for rotation about a horizontal axis spaced vertically and horizontally from said first hinge to define first and second different arcs of travel of said retaining frame between an open position with said retaining frame raised above and non-engaging said pallet and a closed position with vertically disposed side portions of said retaining frame disposed in said close-fitting relationship with the peripheral edge of said pallet; an arm having a forward end fixed to said frame and an opposing end extending rearwardly of said pallet, said opposing end movably mounted to said supporting base between a raised position defining said first hinge and a lowered position horizontally displaced relative to said raised position.

7. The apparatus defined in claim 6 wherein the opposing end of said arm extending rearwardly of said pallet is slideably mounted for travel in a vertical and horizontal direction in a cam slot provided on said supporting base, said arm being pivotally mounted at a selected position within said cam slot to form said first hinge.

8. The apparatus defined in claim 6 wherein said retaining frame includes an L-shaped flange surrounding said opening and includes said vertically disposed side portions conformed to receive said peripheral edge of said pallet in said close-fitting relationship, a portion of said vertically disposed side portions disposed at a forward portion of said frame being configured to engage a portion of a forward edge of said pallet to cooperatively form said second hinge axis during a selected portion of the path of travel of said retaining frame between said open and closed positions.

9. The apparatus defined in claim 8 wherein said portion of said vertically disposed side portions disposed at said forward portion of said retaining frame, includes an inwardly directed leg extending closely adjacent to a lower surface of said pallet when said retaining frame is in said closed position.

10. The combination of a screen printing pallet and retaining frame comprising:

a) a supporting base;

b) a pallet fixed to said base including a outwardly extending, horizontally disposed planar surface for receiving a flexible material for printing and having a peripheral edge surrounding said planar surface;

c) a retaining frame having a central opening and an inner surface conformed to receive the peripheral edge of said pallet in close-fitting relationship to frictionally engage a layer of material disposed between said inner surface of said retaining frame and said peripheral edge of said pallet, a rearward end of said retaining frame being movably mounted to said base for travel between a raised and lowered position including being pivoted about a first horizontal hinge axis in said raised position and horizontally displaced in said lowered position relative to its raised position, a forward edge of said frame being selectively pivotable about a second horizontal hinge axis formed at or near a forwardly disposed edge of said pallet by a cooperative engagement between said forward edge of said frame and said pallet during a selected portion of a path of travel of said frame between a fully open position defined when said retaining frame is raised in non-engaging relationship above said pallet and a fully closed position defined when said inner surface of said retaining frame is disposed in said close-fitting relationship with the peripheral edge of said pallet; and d) means for applying a force operable on said retaining frame at a point located between said first and second hinge axes to cause said retaining frame to move between said open and closed positions.

* * * * *